United States Patent [19]

Albano

[11] 4,267,651

[45] May 19, 1981

[54] BOOT FOR MOTORCYCLISTS PROVIDED WITH MEANS FOR REMOVING AIR FROM THE INSIDE

[75] Inventor: Amedeo Albano, Milan, Italy

[73] Assignee: Pierluigi Nava, Como, Italy

[21] Appl. No.: 3,533

[22] Filed: Jan. 15, 1979

[30] Foreign Application Priority Data

Jan. 25, 1978 [IT] Italy ..... 19579 A/78

[51] Int. Cl.[3] ..... A43B 5/14; A43B 7/06

[52] U.S. Cl. ..... 36/131; 36/3 R

[58] Field of Search ..... 36/131, 3 R, 3 A, 117–121

[56] References Cited

U.S. PATENT DOCUMENTS

| | | | |
|---|---|---|---|
| 1,213,941 | 1/1917 | Patrick | 36/3 A |
| 2,666,207 | 1/1954 | Lucas | 36/3 A |
| 2,701,923 | 2/1955 | Toman | 36/3R |
| 2,703,937 | 3/1955 | McGinn | 36/3 R |
| 3,906,645 | 9/1975 | Heckel | 36/131 |
| 4,062,133 | 12/1977 | McGee et al. | 36/131 |

*Primary Examiner*—James Kee Chi

*Attorney, Agent, or Firm*—Stevens, Davis, Miller & Mosher

[57] ABSTRACT

A boot is described for motorcyclists equipped with means for removing air from the inside thereof, comprising one shoe section made of a flexible synthetic material, one leg section made of a stiff synthetic material, the leg section having a vertical lateral slit-shaped overlapping opening, provided with hook-like closing and tensioning elements, and a small inner shoe characterized in that a first circuit for a moving air stream is formed provided with at least one air inlet opening and with at least one discharge opening for moving air, a second circuit for conducted air abutting at one end an air tap and terminating at the other end into the first circuit, said second circuit comprising a portion of the inner chamber of the small shoe, means for hermetically sealing the small shoe with the leg section, and means for discharging water from the boot.

11 Claims, 8 Drawing Figures

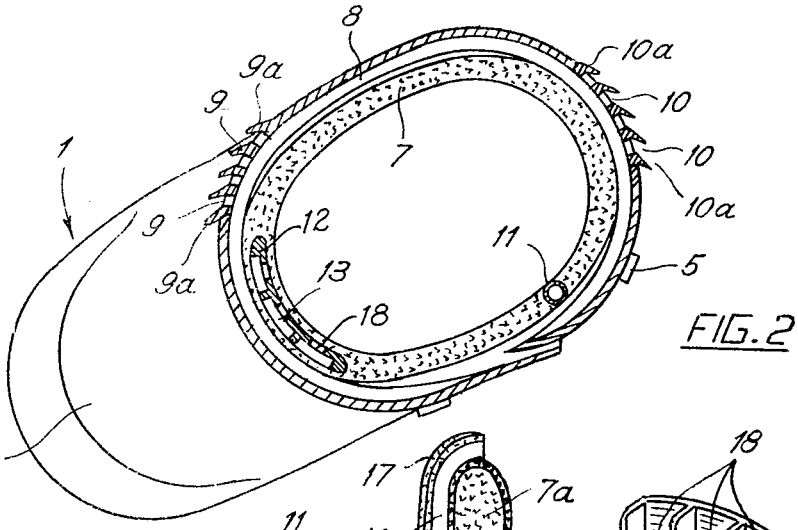
FIG. 2
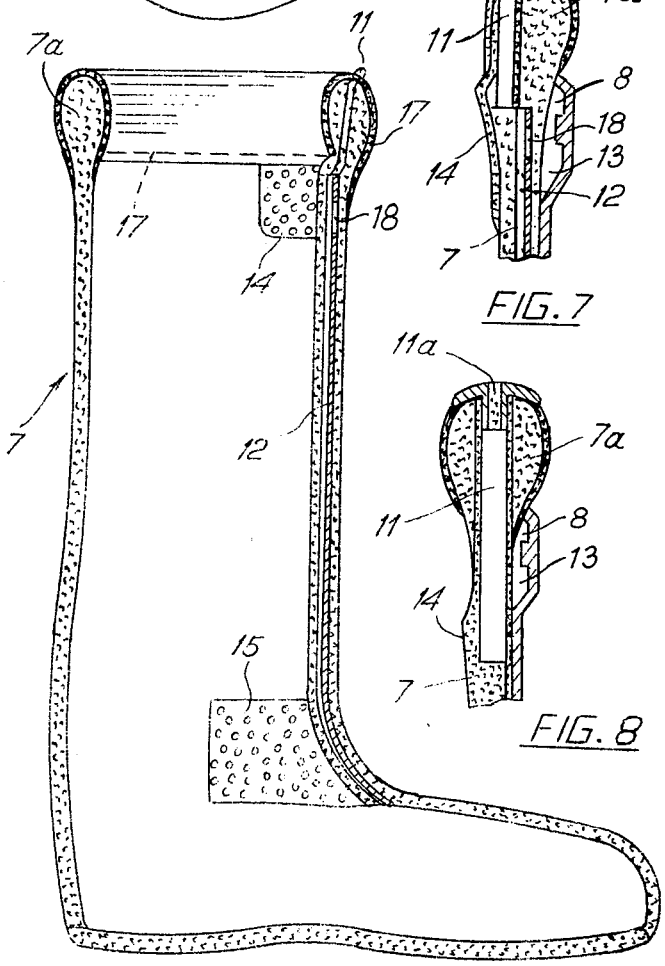
FIG. 3
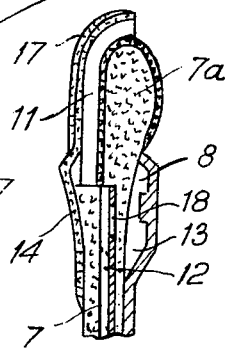
FIG. 7
FIG. 8
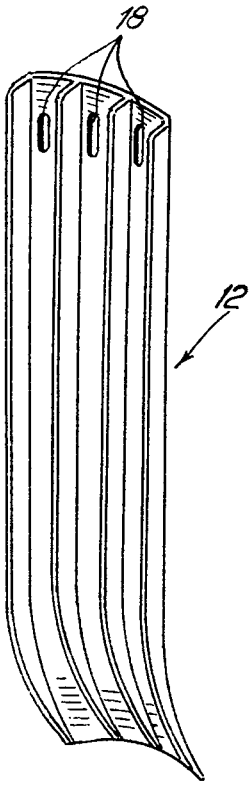
FIG. 4

BOOT FOR MOTORCYCLISTS PROVIDED WITH MEANS FOR REMOVING AIR FROM THE INSIDE

BACKGROUND OF THE INVENTION

The present invention refers to a boot for motorcyclism, in particular for use in motorcross or the like, equipped with means for the removal of air from the inside thereof.

It is already known in the art that, for motorcyclism, and particularly motorcross, boots are usually employed having legs cover, more or less, the lower part of the wearer's leg, below the knee. The boots are put on tightly, and are provided with adjustable closing buckles or hooks, for the purpose of a good adhesion to the wearer's leg, so as to facilitate and safely protect the motorcyclist during the drives to be executed on the motorcycle.

Furthermore, recently boots made of synthetic material have become known, at the inside of which a small shoe is inserted, similar to that used in ski-boots, such a shoe being made of a spongy material, that is of a lining material, incorporating in the front side thereof a vertical insertion in the form of a strip with ribs defining channels and with a pierced top, the said small shoe presenting, at the upper part thereof and in the part which forms the area of the ankle of the foot, a sector pierced with holes on the outside of the small shoe, which correspond with the ends of the vertical insertion. Furthermore the boot presents a number of openings in its upper front part which correspond to the openings of the insertion, wherefore, when the vehicle moves, air enters through the openings to be conveyed through the insertion to the front part of the foot.

According to this proposal, the inflowing air ought to displace the stagnating air within the boot, to create, in such a way, a continual and permanent cycle of ventilation.

However, with the proposed solution, in practice the air which enters initially into the boot stagnates therein, preventing the entrance of further air, since the small shoe adherently surrounds the leg of the wearer, at least the upper part thereof and as a consequence the air contained in the boot has no appreciable ability to be evacuated.

As initially mentioned, the said shoes are put on adherently, that is tightly, resulting in the practice being compromised, and the air contained at the inside of the small shoe is not evacuated.

SUMMARY OF THE INVENTION

The object of the present invention is to remove, in a safe and continuous way, air from the inside of the small shoe of the boot; and at the same time to maintain the inside of the small shoe completely dry.

Within the limits of the foregoing object, the solution according to the invention has a further advantage, due to the fact that the solution can be attained by utilizing normal procedures and machines to press synthetic material and because successive manufacturing or finishing operations are absolutly not required. The proposed solution affects only slightly the cost and therefore has no adverse influence on the the finished product.

Starting with a boot, preferably made of synthetic material, formed, by way of example, with one shoe-part made of a flexible synthetic material and with one part of shoe-leg made of a stiff synthetic material having a laterally open vertical split with a superposition and provided with tensioning hook-shaped closing means, as well as, preferably, an inner small shoe. The object of the present invention is solved in that inside of the boot a first circuit is provided for an air circuit due to motion, provided with a least one opening for the entrance of the air and with at least one discharge opening for the air; and furthermore a second air circuit is provided, connected, at one side, with an air tap and at the other side leading into the air circuit due to motion, the second circuit of conducted air comprising, in the development thereof, a more or less large portion of the length of the inner chamber of the small shoe, means for hermetically sealing the small shoe and, preferably, discharging means for the water of the boot.

According to the invention, it is preferable for the first circuit for the moving the air to be in the upper part of the shoe, whereas, as concerns the second circuit of conducted air, the air tap consists of a tubular element incorporated in the wall of the small shoe, and one end of the element is advantageously accessible to the outer air, means for hindering the simultaneous entrance of water is advantageously interposed between said one end and the other end which leads into the inside of the small shoe.

According to the invention, the outlet of the conducted air circuit into the circuit of the moving air, is realized by means of a duct in the form of an insertion, for example in the form of an ankle-shield, incorporated into the wall of the small shoe and one end is located next to the foot where the corresponding part of the small shoe is pierced, and the other end being next to a sector of the moving air circuit, since in this area the wall of the small shoe is pierced.

Advantageously, according to the invention, the said first circuit for the moving air, preferably in the upper part of the boot, consists of a channel developing peripherally next to the upper edge of the boot, the inner part of the channel being open and realized, after the introduction of the small shoe into the boot, by means of the corresponding lateral surface of the outside of the small shoe presenting at the upper part thereof, a peripheral thickness, cooperating in the creation of the necessary seal with the upper part of the above mentioned channel, the latter being folded, that is curved toward the inside.

Likewise, the channels for the inlet of the air for ventilating purposes and for the conduction thereof into the first circuit for the moving air, can be obtained advantageously, according to the invention, as well by a channel realized in the part of the boot which is used for this purpose, the said channels having their inside open and consisting, after the introduction of the small shoe into the boot, of the lateral surface outside thereof.

Further characteristics, advantages and details of the present invention of the boot, are explained from the following description referring to the annexed drawings, showing the preferred form of an embodiment of a boot as claimed according to the present invention and a number of modified details, as follows:

DESCRIPTION OF THE DRAWINGS

FIG. 2 is a view of the boot shown in FIG. 1, along the sectional line II—II of FIG. 1;

FIG. 3 is a vertical section, through the center of a preferred embodiment of the small shoe according to he invention;

FIG. 4 is a perspective view of the front insertion of the small shoe shown in FIG. 3;

FIGS. 7 and 8 are two details, in enlarged scale, concerning the air tap of the small shoe according to the invention.

DESCRIPTION OF A PREFERRED EMBODIMENT

Figure 5:
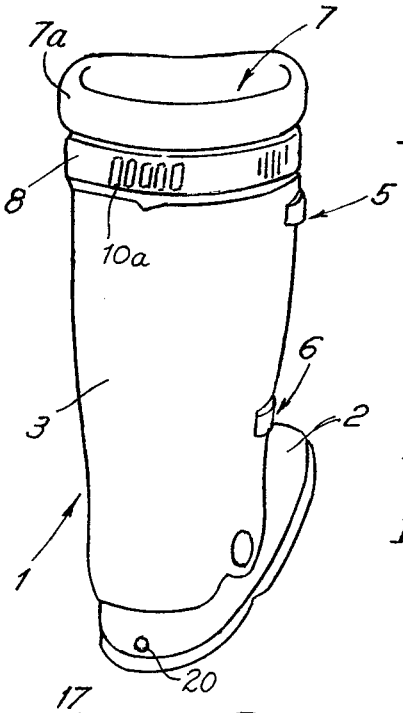
FIG. 5 is a rear view in a smaller scale of the boot according to the present invention.
Figure 6:
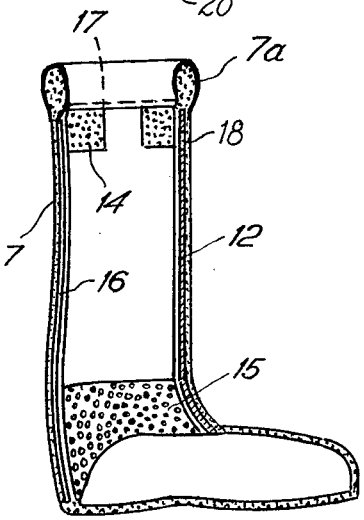
FIG. 6 is the view of a vertical section through the center of a modified embodiment of a small shoe according to the invention.
Figure 1:
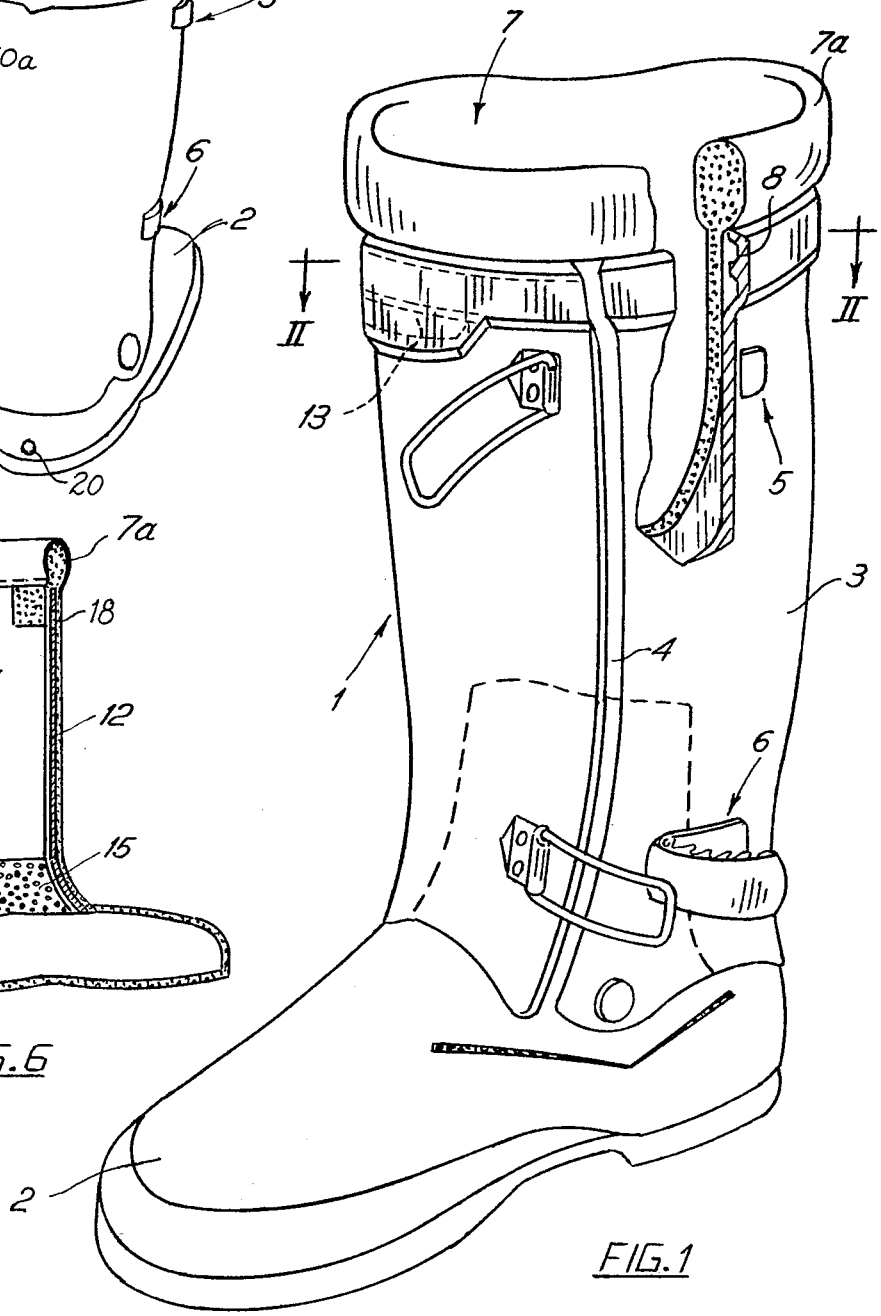
FIG. 1 is a perspective view with a detail cut away of the boot according to the present invention.

With reference to the above mentioned Figures, in which like parts show the same reference numeral, the boot 1 according to the invention is designed. The same includes in the manner known in the art, a shoe part 2, preferably made of a flexible synthetic material and one boot part 3 of a stiff synthetic material, the boot leg showing a lateral opening in the form of a fissure 4 which extends in vertical direction. 5 and 6 indicate hook-like adjustable tensioning members for closing the boot.

At this point the invention intervenes, according to which a first circuit 8 is provided in the boot for a moving current of air whereby inlet opening 9 for the air is provided, situated in the example cited, at the inner part of the boot and next to the upper edge thereof, as well as outlet openings 10 for the exit of the air are provided at the rear part of boot 1. 9*a* indicate small wings designed to intensify the air flow and 10*a* small wings for providing an orientated discharge of the moving air. Still according to the present invention a second circuit for the conducted air is provided, having an air tap 11, consisting of a tubular insertion made of a flexible material, for example of rubber, inserted, that is incorporated in the upper edge *7a* of the small shoe 7. The said circuit for the conducted air continues at the inside of the small shoe 7 and develops thereafter toward the outside through insertion 12 which may be an ankle-saver insertion in the form of a channel and incorporated in the thickness of the shoe-wall, the ends of the channel being situated, at one side, next to the foot and, at the other side, next to chamber 13 contained in channel 8 for the moving air. In the upper area of the small shoe 7, holes 18 are located which terminate in the ring-shaped channel 8, thus establishing a connection between the inside of the shoe and the channel 8, in order to bring air into the inside of the shoe and discharge air to the outside, through the openings 10. Alternatively at the upper part of the small shoe 7, the small shoe is provided with a permeable area designed to advantageously utilize the cellular structure of the lining of said shoe, thus establishing a pneumatic connection between the channels shown by insertion 12 and the ring-shaped channel 8. On the contrary, in the internal areas of the small shoe 7 adjacent to the outlets of insertion 12, said shoes are pierced with holes for the purpose of permitting the free passage of air for ventilation. The areas are numbered, for instance, 14 and 15.

It is pointed out that, for reasons of simplicity, practicality and convenience, the inner part to delimit and to define channel 8, consists, still according to the invention, of the outer lateral surface adjacent to the small shoe 7, the thickened upper edge *7a* which guarantees the necessary sealing of the said channel 8 in cooperation with the upper edge thereof, folded toward the inside.

Advantageously, according to another aspect of the invention, the circuit for the conducted air provides two outlets for the ventilating air, that is in addition to the insertion 12 above mentioned, a further insertion 16 can be provided in the small shoe, for example in the rear part thereof. The insertion delivers air at one side to the inner and lower part of the small shoe and, at the other side, next to channel 8 in the neighorhood of the discharge openings 10. This allows for a particularly efficient ventilation, without a compromise to the flexibility of the small shoe 7.

In case it is desired to omit the incorporation into the small shoe of air-conveying inserts, such as above described, the invention permits still another solution according to which the channels which are provided for the inlet of air and for the discharge of the same, are realized, like channel 8 of the moving air, directly in the leg section 3 of the boot, in the form of channels, with the inner part thereof opened, and closed by means of the outer surface of the small shoe 7, as previously described in relation to channel 8.

In this case it is easily possible to make use of the said channels for stiffening purposes, in particular in the front part of the boot, while the passageway and the development, as well as the position thereof can be selected just as desired.

For the purpose of guaranteeing the water-proof closure of the small shoe 7, the invention foresees a stocking 17 shown with dashed lines, at the outside and that envelopes the small shoe over the greater part of the height thereof.

The above mentioned water discharging means, which can be present between the boot and the shoe, consist of an opening, shown in the drawing as 20, provided in the rear and lower part of the boot, near to the sole thereof. The said opening is advantageously inclined downwardly.

The ventilation is realized as follows:

When the motorcycle moves, an air current penetrates through fissure 9, passes through channel 8 and is discharged through fissure 10. This current of air forms the moving air and causes a depression inside of the small shoe 7, since it has the tendency of forcing air from the inside of said small shoe through insertion 12, which is in communication with channel 8. The said removed air is substituted with fresh air, from air tap 11. In the embodiment with an additional rear insertion, that is with a single one, the operation remains unchanged.

Within the pierced area of the small shoe, a number of outer insertions, made of a slightly stabile, that is the form maintaining and flexible material, as mentioned in 14 and 15 ensure, at all times, the open position of the said pierced holes. It is also possible to use, for the same purpose, a foamed material.

From the foregoing it is clear that, with the solution provided by this invention, the problem concerned is entirely solved, the solution being attained with the use of a simple means and without a special expenditure for raw material and labor.

The small tube 11 for the intake of air can be incorporated by glueing or sewing, when the lining or the like is applied to the small shoe 7.

In the drawing, 11*a* shows a spongy tap-like element which allows for the free entrance of the air and prevents the entrance of water.

In practice, numerous modifications and variations are of course possible, concerning either the structure of the insertions, that is of the corresponding channel used in the boot, and/or the development and location thereof; furthermore, it is possible to freely select the emplacement of the slits 9 and 10 and the shape of the small wings thereof; still further, also the material the boot is made of, as well as the structure thereof can be freely selected, without depassing the limits of the present invention.

All of the features mentioned in the text, in the claims and in the drawings, are considered essential for the present invention.

What is claimed is:

1. A boot for motorcyclists equipped with means for removing air from the inside thereof, comprising one shoe-section made of a flexible synthetic material, one leg-section made of a stiff synthetic material, the last mentioned section having a vertical, lateral slit-shaped overlapping opening, provided with hook-like, closing and tensioning elements, and a small inner shoe, characterized in that a first circuit for a moving air stream is formed, provided with at least one air inlet-opening and with at least one discharge opening for the moving air, a second circuit for conducted air abutting at one end an air tap and terminating at the other end into the first circuit, said second circuit comprising a portion of the inner chamber of the small shoe, means for hermetically sealing the small shoe with the leg section and means for discharging water from the boot.

2. A boot according to claim 1, characterized in that the first circuit for the moving air lies in the upper part of the boot, said circuit consisting of a peripheral channel which can be closed at the ends thereof, said channel being open to the inside of said leg section, the lateral outer surface of the small inner shoe having an upper perimetrical thickness, which co-operates with the open side of the peripheral channel, to hermetically seal said small inner shoe.

3. A boot as claimed in claims 1 or 2, characterized in that the second circuit for the conducted air, provides as an inlet opening for the air, a tubular insertion made of a flexible material incorporated into the small shoe, said circuit continuing thereafter at the inside of the small shoe through a first plurality of openings and then exiting the small shoe, through a second plurality of openings in the inlet area of said second circuit which is incorporated in the small shoe, terminating through a second plurality of openings into an intake chamber in the first air circuit moving air.

4. A boot as claimed in claims 1 or 2, characterized in that said second circuit for the conducted air comprises two insertions incorporated into the small shoe, one being a front circuit and the remaining insertion comprising a rear circuit, said rear circuit emerging in the neighbourhood of the discharge openings for the moving air.

5. A boot, as claimed in claim 1, wherein the means for hermetically sealing the small shoe consist of a waterproof stocking covering substantially the whole outer length of the small shoe.

6. A boot as claimed in claims 1 or 2, wherein the means to discharge the water which may penetrate between the boot and the small shoe, comprises an opening in the rear and lower part of the boot next to the sole thereof.

7. A boot as claimed in claims 1 or 2, characterized in that the inlet and the outlet openings of the first air circuit are provided with small directional wings.

8. A boot as claimed in claim 4, in which the passage of the air through the wall thickness of the small shoe situated before the inlet and the outlet ports of the front insertion and the rear insertion of the small shoe, is aided by a spongy material forming at least partially the wall of the small shoe concerned.

9. A boot for motorcyclists comprising:

an exterior boot housing for enclosing the lower portion of a motorcyclists' leg, said housing having an inner surface, the upper portion thereof having a peripherially extending channel open to the interior of said housing; said channel including opening means to the exterior of said housing for intake and exhaust of a stream of air;

an inner small shoe insertable within said housing; said shoe having an upwardly extending portion lying within said housing when in normal position and providing a surface for sealing the open portion of said channel;

means insertable in said small shoe for forming a second air channel with an interior surface of said inner shoe, said second air channel including an air tap extending beyond the exterior of said housing, and an opening in communication with said peripherally extending channel whereby moving air is conducted to the interior of said shoe; and means for hermetically sealing said inner shoe with said boot housing.

10. The boot of claim 9, further comprising means for discharging water within said boot.

11. The boot of claim 10, wherein said exterior housing has a vertical slot formed therein, said housing including a vertical flap for overlapping said slot, and means for fastening said flap in an overlapping relationship with said slot.

* * * * *